US008776350B2

(12) United States Patent
Cooper

(10) Patent No.: US 8,776,350 B2
(45) Date of Patent: Jul. 15, 2014

(54) SPACER SYSTEMS FOR INSULATED GLASS (IG) UNITS, AND/OR METHODS OF MAKING THE SAME

(75) Inventor: David J. Cooper, Canton, MI (US)

(73) Assignee: Guardian Industries Corp., Auburn Hills, MI (US)

( * ) Notice: Subject to any disclaimer, the term of this patent is extended or adjusted under 35 U.S.C. 154(b) by 76 days.

(21) Appl. No.: 13/067,419

(22) Filed: May 31, 2011

(65) Prior Publication Data

US 2012/0304591 A1 Dec. 6, 2012

(51) Int. Cl.
*B21D 35/00* (2006.01)

(52) U.S. Cl.
USPC ..... 29/469.5; 29/17.1; 29/17.2; 29/505; 29/521; 29/525.14

(58) Field of Classification Search
USPC ..... 29/525.14, 469.5, 505, 521, 505.01, 29/525.13, 525.01, 17.1, 17.2; 52/786.13
See application file for complete search history.

(56) References Cited

U.S. PATENT DOCUMENTS

| | | | | |
|---|---|---|---|---|
| 5,514,476 | A | 5/1996 | Hartig et al. | |
| 5,705,010 | A * | 1/1998 | Larsen | 156/196 |
| 5,784,853 | A | 7/1998 | Hood et al. | |
| 5,800,933 | A | 9/1998 | Hartig et al. | |
| 6,014,872 | A | 1/2000 | Hartig et al. | |
| 6,632,491 | B1 | 10/2003 | Thomsen et al. | |
| 6,823,644 | B1 | 11/2004 | Peterson | |
| 2007/0128449 | A1 | 6/2007 | Taylor et al. | |
| 2009/0120018 | A1 | 5/2009 | Trpkovski | |
| 2009/0120019 | A1 | 5/2009 | Trpkovski | |
| 2009/0120035 | A1 | 5/2009 | Trpkovski | |
| 2009/0120036 | A1 | 5/2009 | Trpkovski | |
| 2009/0123694 | A1 | 5/2009 | Trpkovski | |
| 2012/0308746 | A1 * | 12/2012 | Cooper | 428/34 |

FOREIGN PATENT DOCUMENTS

| | | |
|---|---|---|
| FR | 1 248 713 | 12/1960 |
| WO | WO 2004/038155 | 5/2004 |
| WO | WO 2009/103511 | 8/2009 |
| WO | WO 2009//124770 | 10/2009 |
| WO | WO 2010/094446 | 8/2010 |

OTHER PUBLICATIONS

International Search Report mailed Oct. 12, 2012.
U.S. Appl. No. 13/067,420, filed May 31, 2011; Cooper.
International Search Report mailed Sep. 19, 2012.

* cited by examiner

*Primary Examiner* — David Bryant
*Assistant Examiner* — Ryan J Walters
(74) *Attorney, Agent, or Firm* — Remarck Law Group PLC

(57) ABSTRACT

Certain example embodiments relate to improved spacers for insulated glass units. Certain example embodiments relate to corrugated spacers that extend around a periphery of an IG unit. In certain example embodiments, the spacer includes at least one structured concave cavity. When positioned in conjunction with a substrate, the cavity may be filled with a sealant. In certain example embodiments, the sealant may be a thermoplastic sealant. In certain example embodiments, another cavity may be provided that may accept a structural sealant. In certain example embodiments, the thickness of the corrugated faces of a spacer may be less than the thickness of the shoulders of spacer.

6 Claims, 10 Drawing Sheets

SPACER SYSTEMS FOR INSULATED GLASS (IG) UNITS, AND/OR METHODS OF MAKING THE SAME

FIELD OF THE INVENTION

Certain example embodiments of this invention relate to improved spacers systems for insulated glass (IG) units, and/or methods of making the same. More particularly, certain example embodiments relate to an improved spacer system that includes corrugations in the spacer. Certain example embodiments include thermoplastic spacer (TPS) material.

BACKGROUND AND SUMMARY OF EXAMPLE EMBODIMENTS OF THE INVENTION

Insulated glass (IG) units are known in the art. See, for example, U.S. Pat. Nos. 6,632,491; 6,014,872; 5,800,933; 5,784,853; and 5,514,476, and also U.S. Publication No. 2007/0128449, the entire contents of each of which are hereby incorporated herein by reference.

Insulating glass units generally include two panes, sheets, substrates, or lites of glass in substantially parallel spaced apart relation to one another, with an optionally gas filled pocket therebetween. As shown in FIG. 1, two sheets 10 are sealed together through the use of seals/spacers 12 around the edges of the two sheets. The sealing components in a conventional IG unit may include both a sealer component and a spacer component. The spacer component may act to support the weight of the substrates by holding them apart (and thus forming a gap therebetween). Construction of spacers for IG units is known in the art. See, for example, U.S. Publication Nos. 2009/0120019; 2009/0120036; 2009/0120018; 2009/0120035; and 2009/0123694, the entire contents of each of which are hereby incorporated herein by reference.

The seals may act to hold the substrates together. In certain instances, these edge seals may be hermetic seals. The use of hermetic seals may allow for the gap between the substrates to be filled with a gas. In certain conventional IG units, a desiccant may be exposed to the interior gap between the substrates. The desiccant may act to keep this interior gap dry (e.g., decrease condensation).

Once sealed, the IGU is formed and may be installed in a commercial, residential, or other setting. In comparison to a single paned window, a standard double paned window may have an R-value more than 2. IG units may have yet higher R-values. Additional techniques may be used to yet further increase the R-value of a window. One conventional technique involves disposing a low-E coating 14 to a surface of one of the substrates. Another technique involves tinting the glass substrates. Some techniques may be applied to decrease the heat transference over the gap between the two substrates 10, for example, by creating a vacuum or near-vacuum between the two panes of glass or filing the gap with a gas such as argon. However, while air between the substrates may have poor heat transference properties (e.g., a high R-value), the spacers around the edges may be constructed out of materials with lower R-values (e.g., a metal). This potential path may allow increased heat transference over the spacer. This, in turn, may lead to increased heat loss from the interior of a structure to the exterior portion (or visa versa).

New techniques of reducing heat transference are continually sought after in order to improve, for example, the energy efficiency of windows. Also, new techniques in making IG units are also continuously sought after for reducing the overall cost of the IG unit. Thus, it will be appreciated that techniques for creating IG units that may include spacers and/or seals for glass articles are continuously sought after.

In certain example embodiments, an improved spacer may include one or more corrugated faces. In certain example embodiments, the corrugations may improve the structural stability of the spacer in one direction while increasing flexibility in another direction.

In certain example embodiments, a spacer may be designed to work with TPS material (e.g., TPS that is reactive and used for structural sealant) such that a separate desiccant element may not be needed for an IG unit. In certain example embodiments, the spacer may be a complete seal with a decreased number of perforations or no perforations.

In certain example embodiments, the spacer may be designed such that the spacer structure may act as a double barrier against moisture penetration.

In certain example embodiments, a combination of a stainless steel spacer with a reactive TPS material may result in a thirty percent reduction in total cost of an IG unit.

In certain example embodiments, an insulated glass unit is provided. The insulted glass unit includes first and second substantially parallel, spaced apart glass substrates, where the first and second glass substrates define a gap therebetween. A spacer is provided around a periphery of the first and second substrates. The spacer includes first and second substantially parallel portions that are corrugated or undulate along the periphery. In certain example embodiments, the undulation is formed by roll-formed corrugations. The spacer includes first and second shoulders that connect the first and second substantially parallel portions to form an enclosed area. The first and second shoulders are structured to form a concave cavity between at least one of the shoulders and the respective glass substrate. A sealant material is disposed within the concave cavity and structured to form an edge seal around the periphery of the first and second substrates.

In certain example embodiments, a method of making an insulated glass unit is provided. First and second glass substrates are positioned in substantially parallel, spaced apart relation to one another and define a gap therebetween. A spacer is disposed between, and around a periphery of, the first and second substrates, the spacer including first and second substantially parallel portions that undulate along the periphery thereof. The spacer includes first and second shoulders that, along with the first and second substantially parallel portions, form an enclosed area; the first and/or second shoulders are structured to form at least one concave cavity between at least one of the shoulders and the respective glass substrate. At least one of the concave cavities is filled with a sealant.

In certain example embodiments, a spacer configured to interface with an insulated glass unit including first and second substantially parallel spaced apart substrates is provided. The spacer includes first and second substantially parallel, undulating portions. The spacer further includes first and second shoulders that connect the first and second substantially parallel, undulating portions to form an enclosed area, where the first and second shoulders are adapted to support or interface with the first and second substrates of the insulated glass unit. The first and second shoulders are concavely shaped with respect to the first and second substrates such that cavities are formed between the respective shoulders and the first and second substrates. The cavities are adapted to receive a sealing material.

In certain example embodiments, a method of making a spacer is provided. A base article with first and second shoulder portions is positioned or provided. First and second substantially parallel, undulating bands are formed in the base article in a first direction. The base article is shaped in a second direction that is substantially transverse to the first direction to thereby form an enclosed area. The first and second shoulders are formed to be adapted to support first and second substrates of an insulated glass unit, with the first and second shoulders being shaped concavely with respect to the first and second substrates such that cavities are formed between the respective shoulders and the first and second substrates. The cavities are adapted to receive a sealing material.

In certain example embodiments, a method of making a spacer that is configured to interface with an insulated glass unit including first and second substantially parallel spaced apart substrates is provided. A base pre-formed article is positioned or provided. The base pre-formed article is shaped to include first and second substantially parallel, undulating bands. First and second shoulders are formed into the base pre-formed article, with the formed first and second shoulders structured to, respectively, support the first and second substrates of the insulated glass unit, the first and second shoulders being shaped concavely with respect to the first and second substrates such that cavities are formed between the respective shoulders and the first and second substrates. The base pre-formed article has an enclosed area and the cavities formed by the shoulders are structure to hold a sealing material.

The features, aspects, advantages, and example embodiments described herein may be combined in any suitable combination or sub-combination to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION OF EXAMPLE EMBODIMENTS OF THE INVENTION

The following description is provided in relation to several example embodiments which may share common characteristics, features, etc. It is to be understood that one or more features of any one embodiment may be combinable with one or more features of other embodiments. In addition, single features or a combination of features may constitute an additional embodiment(s).

Figure 1:
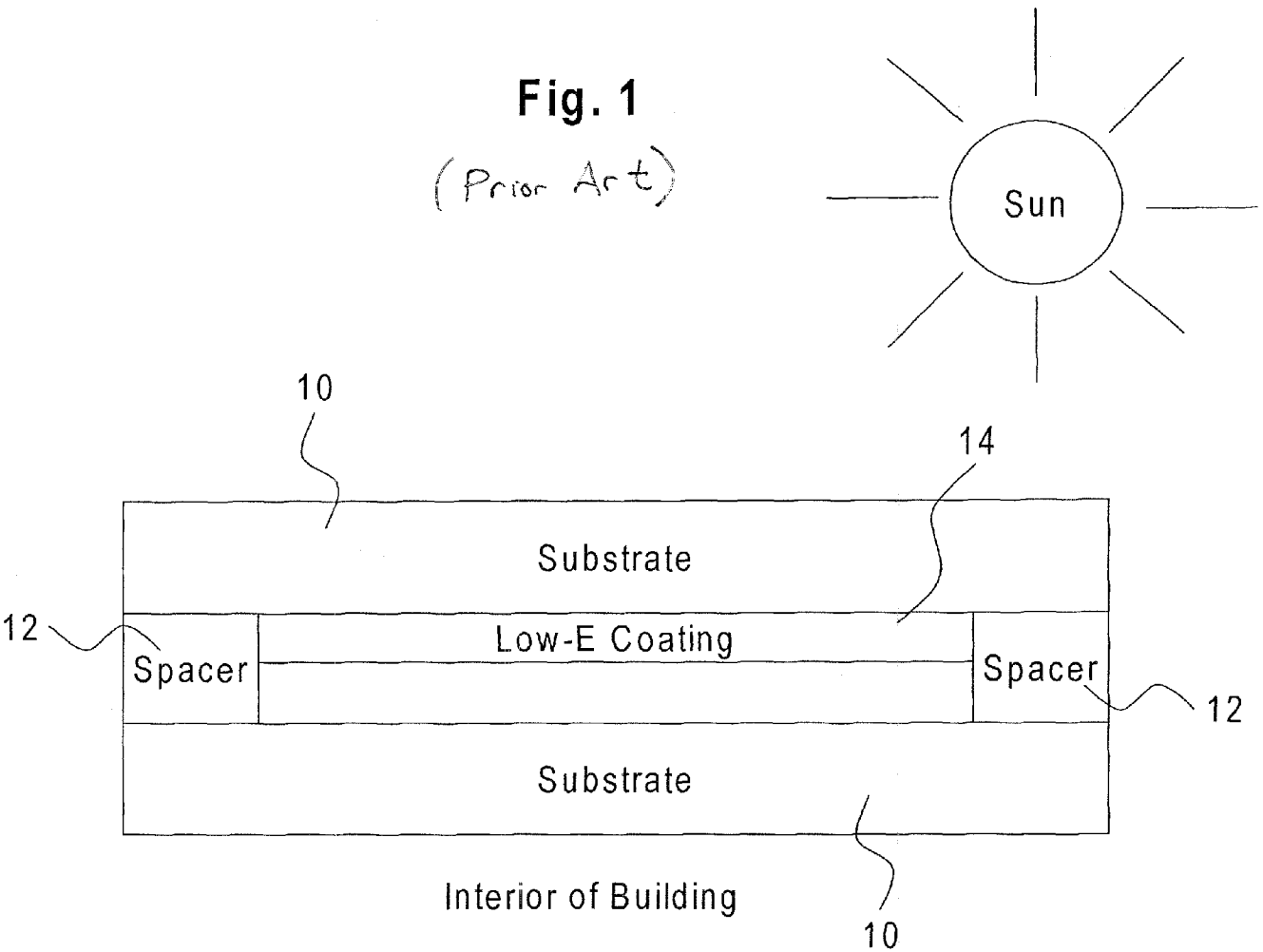
Fig. 1 (Prior Art)
FIG. 1 is a cross-sectional view of a conventional IG unit.
Figure 2B:
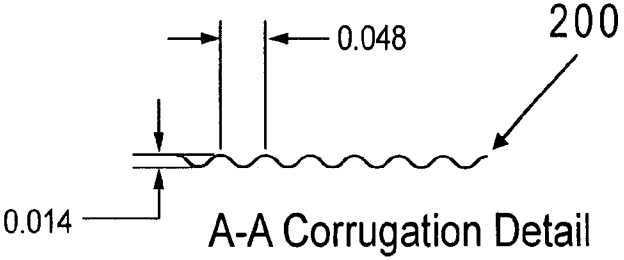
FIG. 2B is a cross-sectional view of FIG. 2A.
Figure 2A:
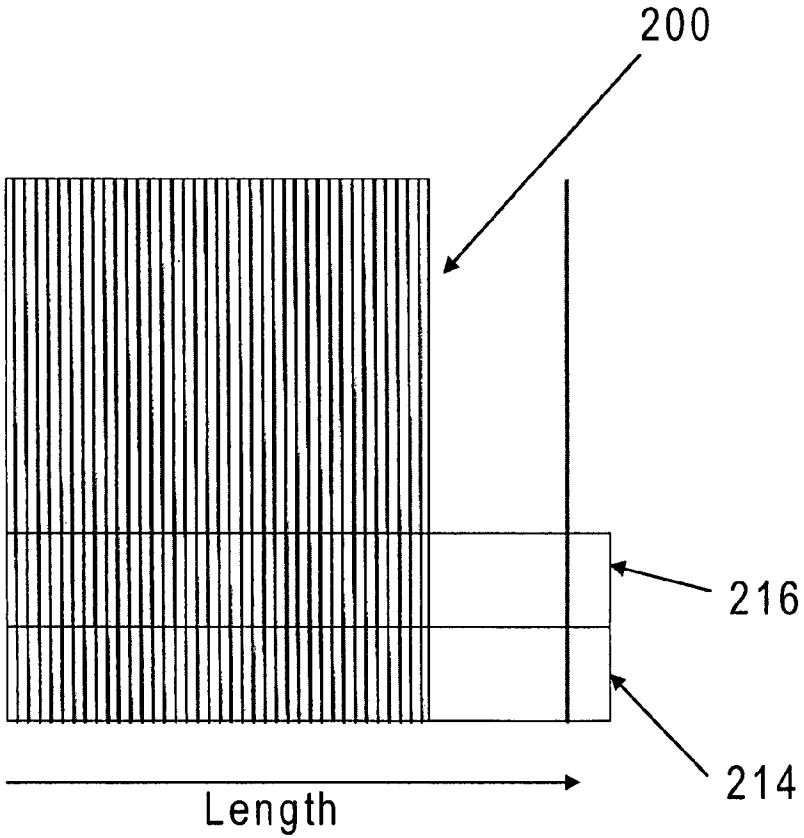
FIG. 2A is a plan view of an example corrugated material used in certain example embodiments.

Referring now more particularly to the accompanying drawings in which like reference numerals indicate like parts throughout the several views, FIG. 2A is a plan view of an example corrugated material used in certain example embodiments, and FIG. 2B is a cross-sectional view of the example material shown in FIG. 2A. The spacer material 200 may be made out of any suitable material for spacers. In certain example embodiments, the material may be stainless steel. Stainless steel may have a relatively low thermal conductivity versus other similar materials used in spacer construction. Accordingly, in certain example embodiments, a spacer made out of stainless steel may impede thermal transfer across the spacer member. Furthermore, as steel is relatively structurally rigid, using steel in a spacer system advantageously may impart rigidity to the IG unit edge construction.

A spacer material 200 may be formed by taking a sheet of material (e.g., stainless steel) and roll-forming the sheet to obtain the corrugated spacer material 200. Corrugated spacer material 200 may then be cut to form corrugated strips 214 and 216. The size of corrugated spacer material 200 may be adjusted based on the particular application. In certain example embodiments, the length of the spacer material may be sufficient to encompass the perimeter of a glass substrate. As explained in greater detail below, this may facilitate the use of one continuous piece of spacer material for the spacer.

Figure 2D:
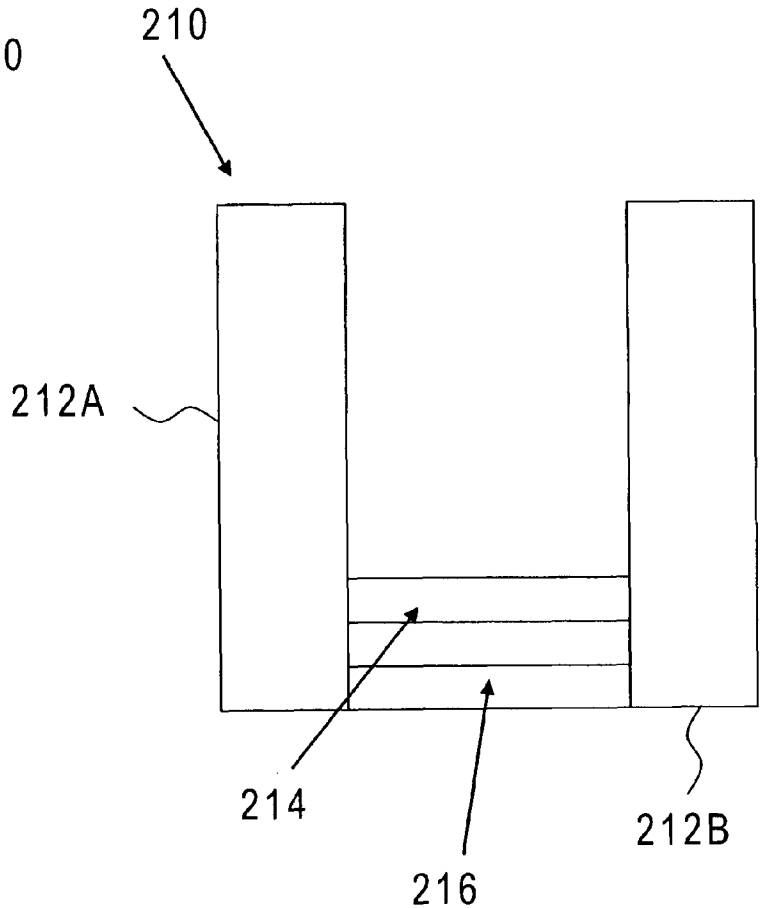
FIG. 2D is a cross sectional view of the example IG unit of FIG. 2C according to certain example embodiments.
Figure 2C:
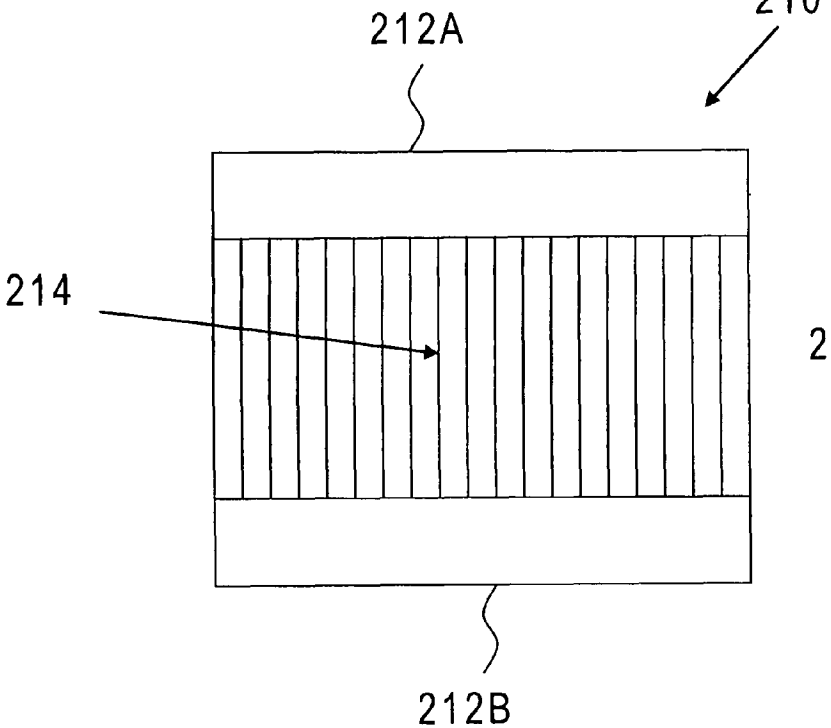
FIG. 2C is a top-down view of an example IG unit using a spacer according to certain example embodiments.

FIG. 2C is a top-down view of an example IG unit using a spacer according to certain example embodiments, and FIG. 2D is a cross-sectional view of the example IG unit of shown in FIG. 2C. IG unit 210 includes two substrates 212A and 212B connected by corrugated spacers 214 and 216. Although not shown, certain example embodiments may include one sheet of corrugated spacer material holding the substrates together. However, a preferred embodiment may include two or more strips of corrugated spacer material connected by additional spacer material (that may or may not be corrugated). In certain example embodiments, the corrugations in the material may facilitate bending of the spacer material. This property advantageously may help the spacer material to be bent around a corner (or corners) of a substrate, for example. In addition, or in the alternative, certain example embodiments may use multiple strips that are welded or otherwise connected in order to form a continuous length of material around the edge of substrates 212A and 212B.

Figure 3B:
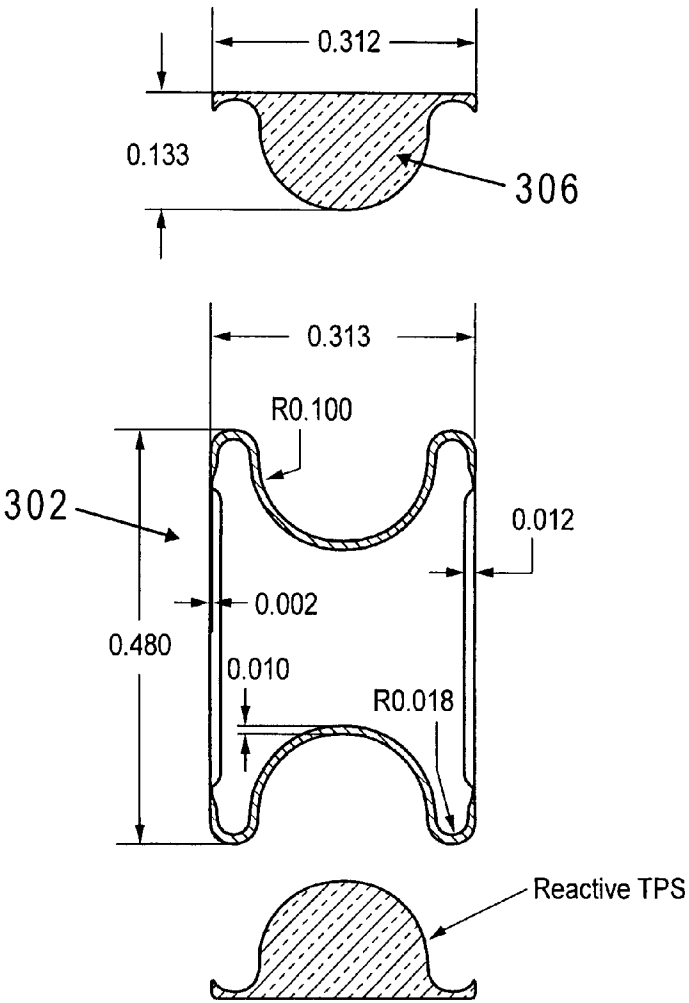
FIGS. 3A and 3B show illustrative views of an example IG unit incorporating an example spacer according to certain example embodiments.
Figure 3A:
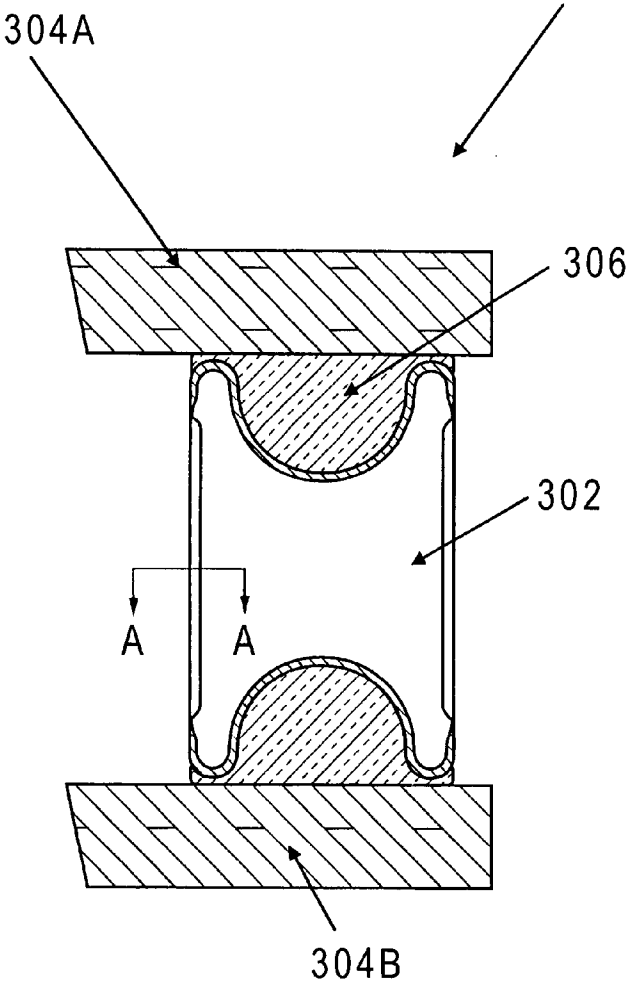

FIGS. 3A and 3B show illustrative views of an example IG unit and spacer according to certain example embodiments. An example IG unit 300 includes glass substrates 304A and 304B. It will be appreciated that the A-A section corresponds to the arrangement shown in FIG. 2B. An improved spacer 302 may be disposed between the glass substrates 304A and 304B. As discussed above, in certain example embodiments, spacer 302 may be constructed out of stainless steel. However, it will be appreciated that other types of materials may be used to construct a spacer including, for example, plastic, rubber, ceramic, iron, and/or the like.

Spacer 302 may be formed with a generally semi-circular cavity on the shoulders to hold a desired amount of reactive TPS (or other structural) sealant 306. In certain example embodiments, the TPS may include a desiccant component for an initial moisture drawdown upon assembly of an IG unit. The addition of a desiccant component may also help to absorb future moisture leakage into an IG unit. Exemplary TPS material includes, for example, "Koedispace 4SG" from Kommerling Chemische Fabrik GmbH.

As the TPS matrix may itself include a desiccant component, an IG unit may not contain desiccant beads, desiccant matrices, or the like, in certain example embodiments. It will be appreciated that removing these components from the assembly of an IG unit may help to improve the thermal efficiency of the IG, as desiccant beads and the like may sometimes reduce the overall thermal efficiency of IG units containing the beads. It will be appreciated that reducing the need for a desiccant may save costs for an associated IG unit in certain situations. In certain instances, the cost saving may be about 2 to 3 cents per lineal foot. Further, removing a separate desiccant material from the IG assembly process may reduce the time and/or number of separate steps involved in preparing and/or constructing and IG unit.

TPS may replace the use of primary and/or secondary sealants in certain example embodiments. TPS 306 may fill the side cavities to seal the IG unit and provide a structural bond between the substrates 304A, 304B and the spacer 302. The generally semi-circular shape on the shoulders of spacer 306 may allow for a desired volume of TPS that includes desiccant. This may allow for an extended, and sometimes even for the lifetime of the unit, moisture control of the IG unit. The layout of the TPS material (and associated desiccant component) may create an extended path for moisture or gas diffusion. This path may function by extending the effective permeation distances of both moisture in and/or gas fill out. This properties may relate (e.g., equate) to extended longevity of the IG unit 300 over other conventional IG designs.

Spacer 302 may include a portion of material that is relatively thicker than the portion of material across both faces of the spacer 302. This design may promote a reduced thermal conduction perpendicular to the substrates 304A and/or 304B. In certain example embodiments, the corrugated faces may be between 0.001 to 0.015 inches, more preferably between about 0.001 and 0.003 inches in thickness. The shoulders of spacer 302 may be thicker than the corrugated faces and have a thickness of between 0.005 and 0.015 inches, more preferably between about 0.006 and 0.012 inches. The increase in thickness of material on the shoulders of spacer 302 may facilitate bending of the material (e.g., to form a cavity to hold the TPS 306).

Figure 4A:
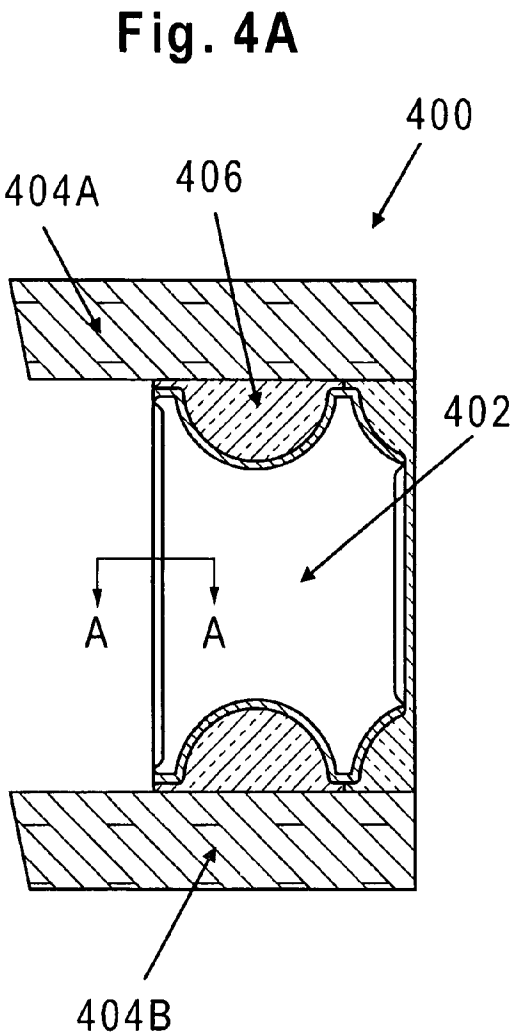
FIGS. 4A-4D are illustrative views of an example IG unit with spacers according to certain example embodiments.
Figure 4B:
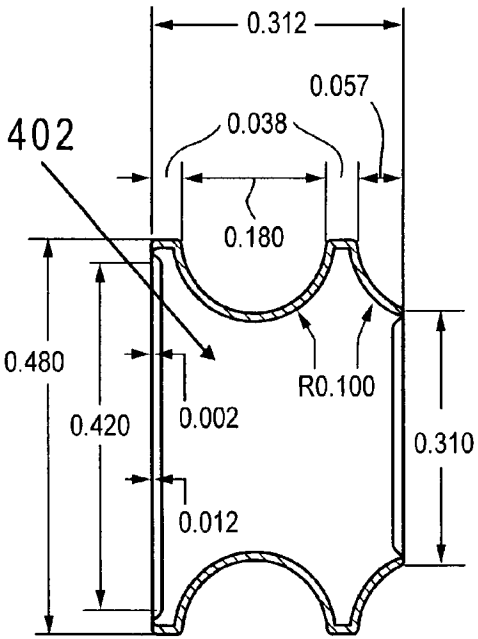
Figure 4C:
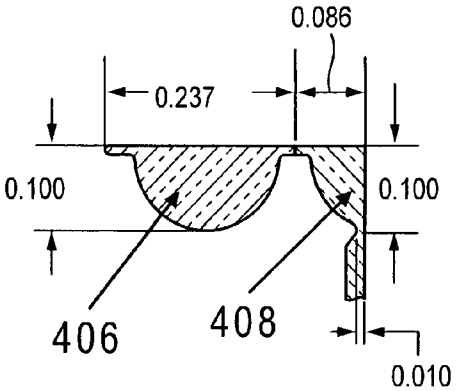
Figure 4D:
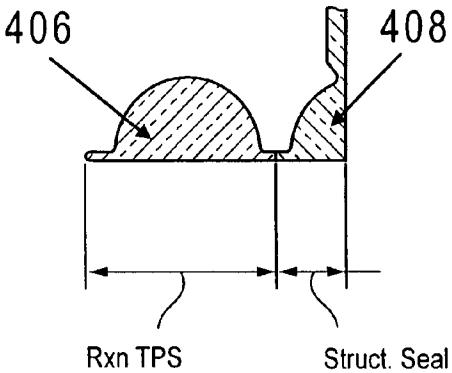
Figure 5C:
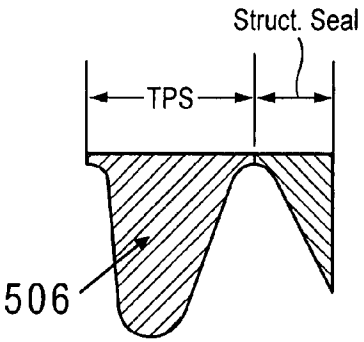
FIGS. 5A-5D are illustrative views of an example IG unit incorporating another example spacer according to certain example embodiments.
Figure 5D:
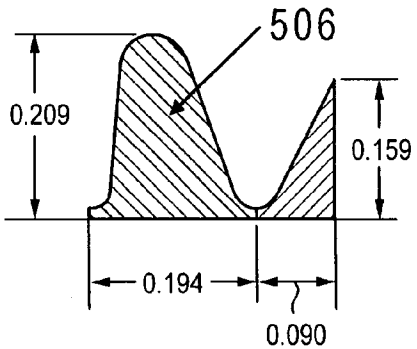
Figure 5B:
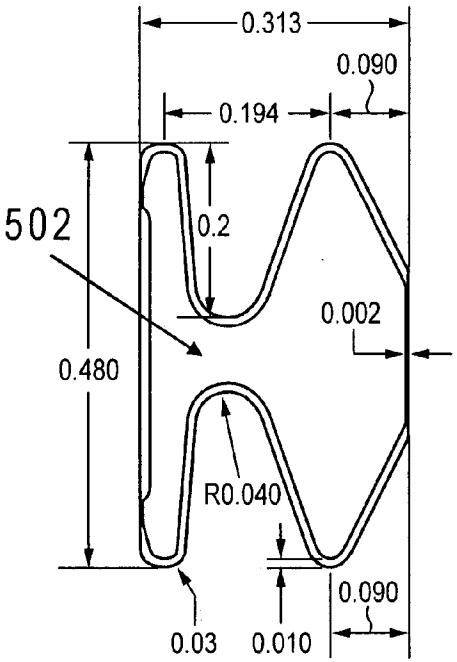
Figure 5A:
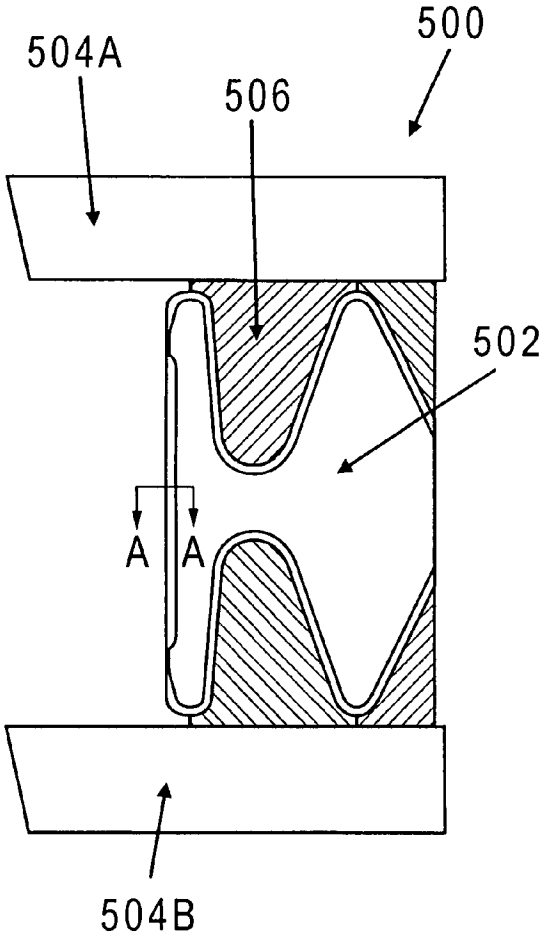

FIGS. 4A-4D are illustrative views of another example IG unit with a spacer according to certain example embodiments. As above, the A-A section corresponds to the arrangement shown in FIG. 2B. Exemplary dimensions (in inches) are shown in FIGS. 4B-4D. An IG unit 400 may include substantially parallel, spaced apart glass substrates 404A and 404B. Disposed at the periphery of the IG unit on substrates 404A and 404B may be spacer 402. The spacer 402 may be of a double cavity design that includes TPS 406 and a separate structural seal 408. The TPS 406 may be a reactive or non-reactive (normal) type of TPS in certain example embodiments. The separate structural seal 408 may be skim coated around the periphery of the IG unit in certain example instance.

FIGS. 5A-5D are illustrative views of a further example IG unit using an example spacer according to certain example embodiments. As above, the A-A section corresponds to the arrangement shown in FIG. 2B. Exemplary dimensions (in inches) are shown in FIGS. 5A-5D. An IG unit 500 may include substantially parallel glass substrates 504A and 504B. Disposed between the glass substrates 504A and 504B and around the edge of the glass substrates may be a spacer 502 with a double cavity design. TPS 506 and a separate structural seal 508 may be provided in connection with the spacer. In certain example embodiments, the TPS 506 may be a reactive or non-reactive (normal) type of TPS.

The secondary seal (e.g., 408 and 508) may be a structural sealant such as silicone, polysulfide, polyurethane, and/or reactive butyl that may be applied via skim coating or the like. In certain example embodiments the TPS used may be of a reactive type or a normal type.

Figure 6A:
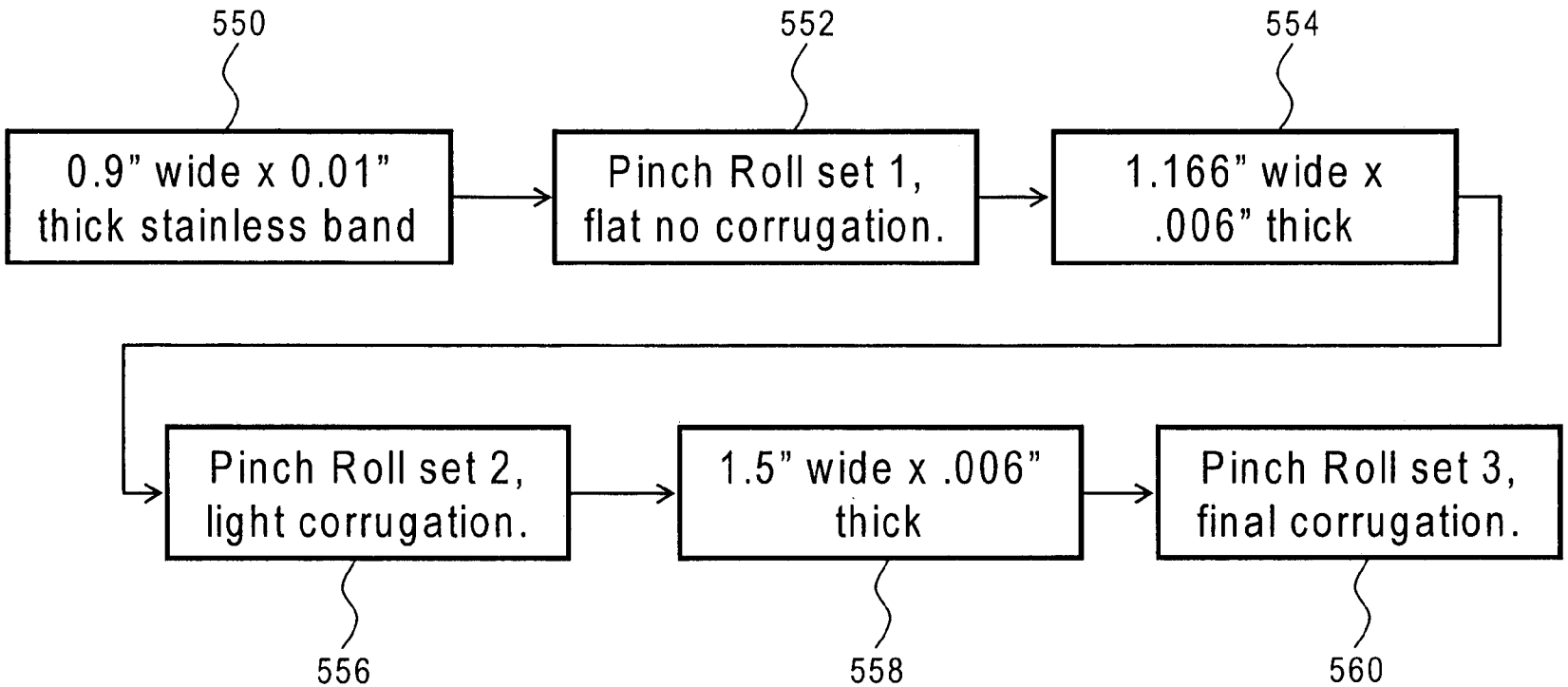
FIG. 6A shows an example process used in forming a spacer according to certain example embodiments.
Figure 6B:
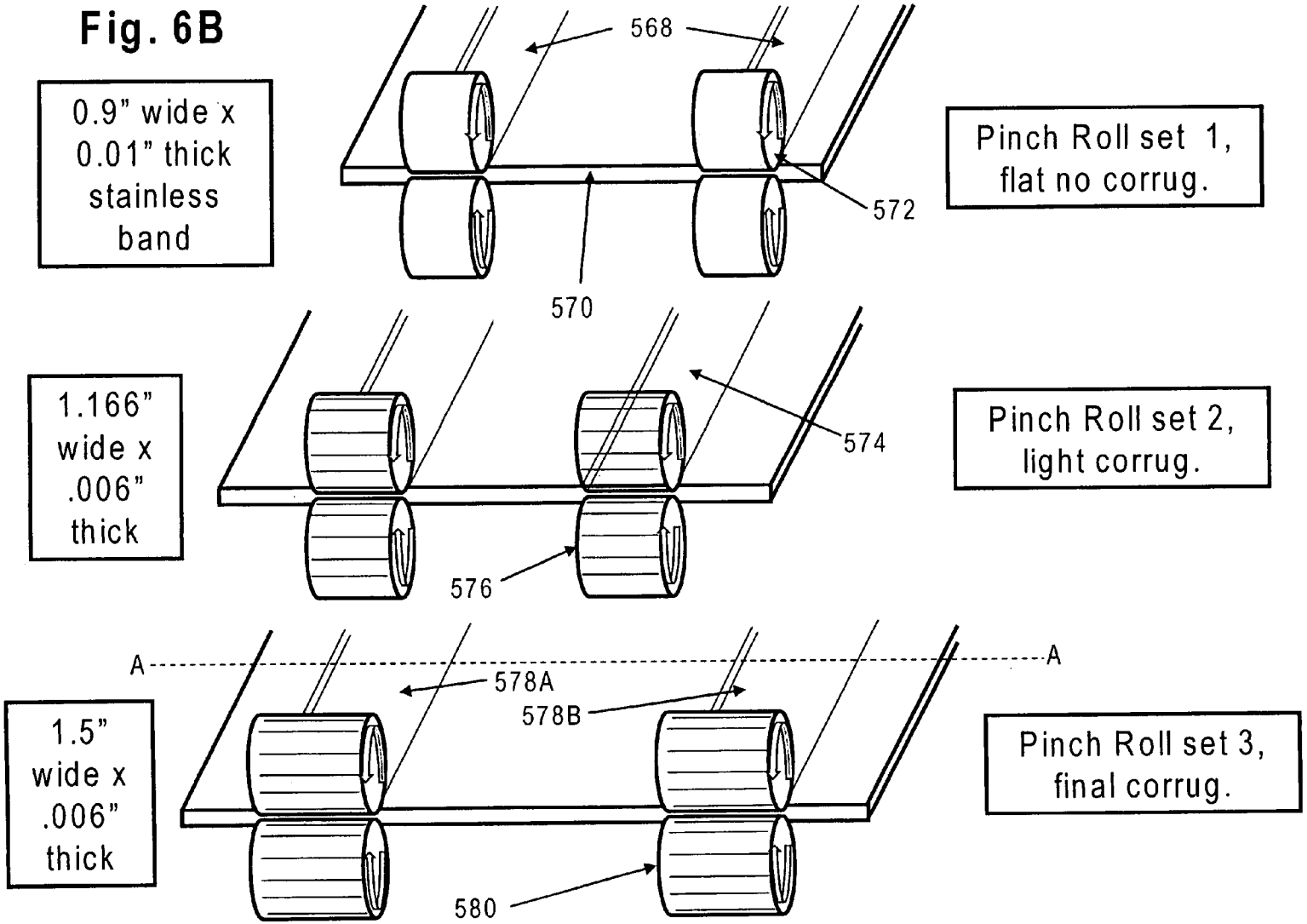
FIG. 6B is a diagrammatic representation of the process of FIG. 6A

FIGS. 6A and 6B show an example process for forming a spacer according to certain example embodiments. In certain example embodiments, an improved spacer may be formed by starting with a basic sheet of stainless steel. It will be appreciated that other types of materials may be used for the techniques described herein. For example, aluminum, plastic, or other types of metals or materials may be used to form an improved spacer. In any event, in steps 550 and 552, a sheet 570 of stainless steel is roll formed through roll formers 572. As a result of moving through the roll formers 572, a 0.9 inch wide by 0.01 thick band 568 is produced in the stainless steel sheet 570. It will be appreciated that that width and thickness of the application of the roll forming may vary depending on a given application. For example, the width may be 1.5 inches and the thickness of the roll forming may be 0.1 inches in thickness in certain example embodiments. Thus, the width and/or depth may vary.

After forming the flat bands, steps 554 and 556 are performed. In these steps, the roll forming may create a light corrugation in the sheet 570. Thus, sheet 570 is fed or otherwise conveyed through roll formers 576 to create a corrugation band 574 that may be about 1.166 inches wide by 0.006 inches thick, e.g., in an area proximate band 568.

The roll forming process may then be repeated in steps 558 and 560 by feeding the sheet 570 through roll formers 580 to create a deeper corrugation band 578 that may be about 1.5 inches wide by 0.006 inches in thickness, e.g., in the same or other areas.

In certain example embodiments the roll forming process may include roll forming multiple bands into a sheet of material. For example, as shown in FIG. 6B, two corrugation bands may be formed into the stainless steel sheet 570.

In certain example embodiments, other roll forming operations may operate to create further and/or different corrugations in a give sheet. For example, with respect to the example spacers with exemplary corrugations in FIGS. 4A-4C, additional tools may be used to roll form the bulging sections of the spacer. Further, additional roll forming steps may be implemented according to certain example embodiments to further roll form a sheet.

In certain example embodiments, a roll forming operation may be set up so that the hills and valleys in the corrugations of two or more bands are synchronized from one band to the next band. In other words, for example, as sheet 570 passes through roll formers 580 the hills and valleys of the shown bands in FIG. 6B line up.

In certain example embodiments, the metal band may be annealed between certain roll steps. This is because it will be work hardened as it is formed through the tooling process.

Figure 6C:
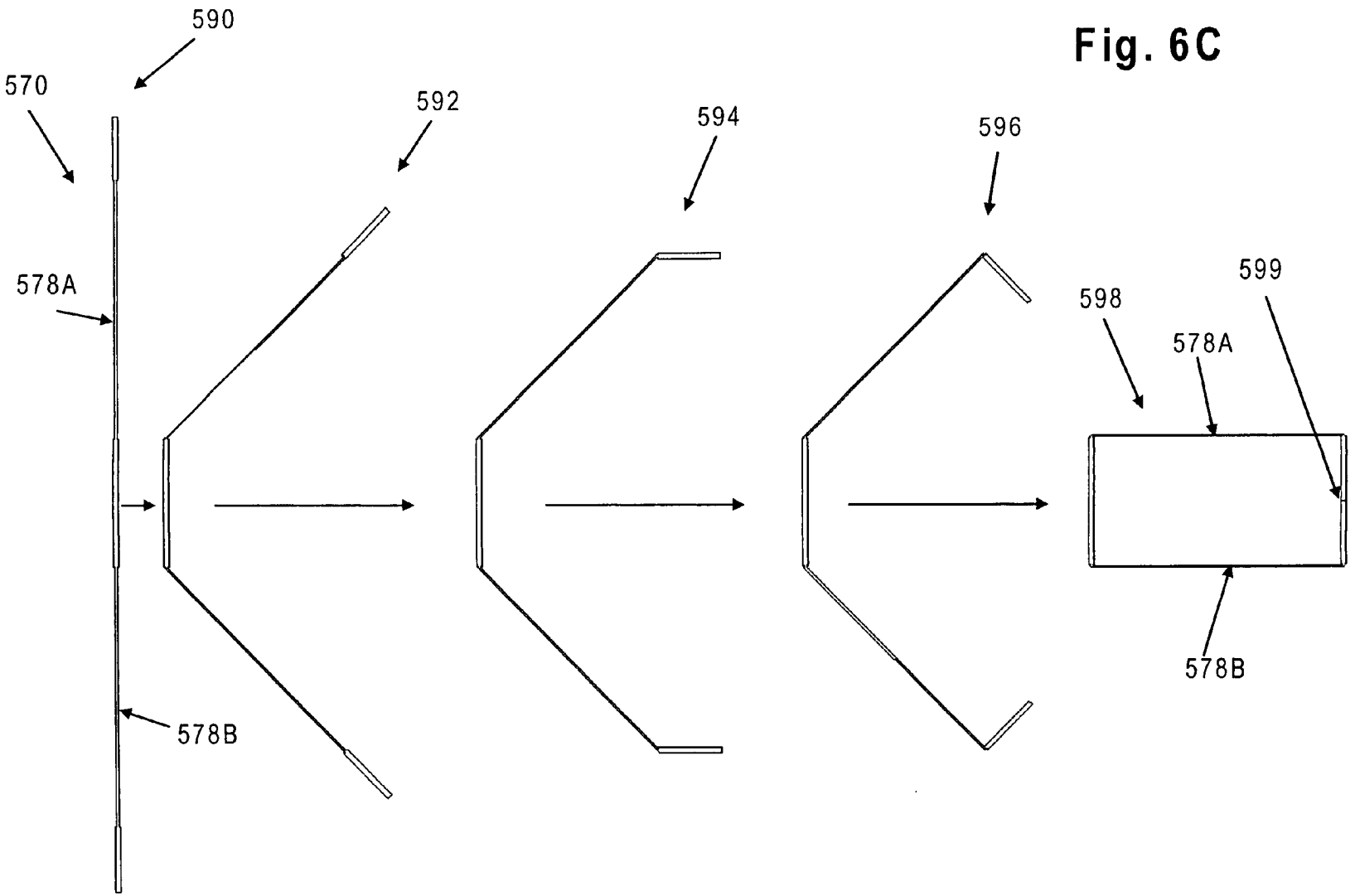
FIG. 6C shows an illustrative process for forming a spacer according to certain example embodiments.

FIG. 6C shows illustrative cross-sectional views of a process for forming a spacer according to certain example embodiments. A corrugated sheet may be formed into a spacer according to certain example embodiments. Here, sheet 570 from FIGS. 6A-6B is displayed in relation to the cross-section A-A from FIG. 6B. Sections 578A and 578B similarly correspond to the roll formed corrugation section from FIG. 6B.

From the corrugated sheet 570 the process of forming a spacer may begin at state 590 and proceed to states 592, 594 and 596, respectively. In each state the sheet may be gradually formed into the desired spacer shape. State 592 may bend the respective corrugation bands. States 594 and 596 may bend or shape the non corrugated sections. In certain example embodiments, the shaping/bending may be done through a series of in-line rolls. In state 598 the two non-corrugated sub-sections may be joined. In certain example embodiments, these to sub-sections may then be combined at point 599 to form one continuous enclosed spacer. In certain example embodiments, the seam at point 599 may be laser welded. Alternatively, or in addition, different adhering techniques may be used (e.g., through an adhesive or application of bracers).

In certain example embodiments, a flat non-corrugated piece of material may be formed in a manner similar to that shown in FIG. 6C. After forming the enclosed area the corrugated sections 578A and 578B may be formed. Thus, a base spacer may be preformed with an enclosed area. Subsequently, corrugated sections may be formed. Further, the shoulder sections (e.g., the portions that interface with glass substrates) may be shaped to form one or more cavities in the shoulder sections. In certain example embodiments, the formed cavities may be structured to hold a structural sealant.

In certain example embodiments, one corrugated section may be used. Alternatively, more than two corrugated sections may be applied depending on a given application or spacer design.

As an alternative to, or in conjunction with, the roll forming technique described above, certain example embodiments may stamp the corrugations into place. For example, a stamp machine may be used to stamp segments of a sheet as it progress through the stamp machine.

In certain example embodiments, the laser welding may occur substantially in conjunction with the process of forming the spacer. This technique may advantageously decrease and sometimes even completely eliminate the presence of breather holes in the spacer.

Figure 7:
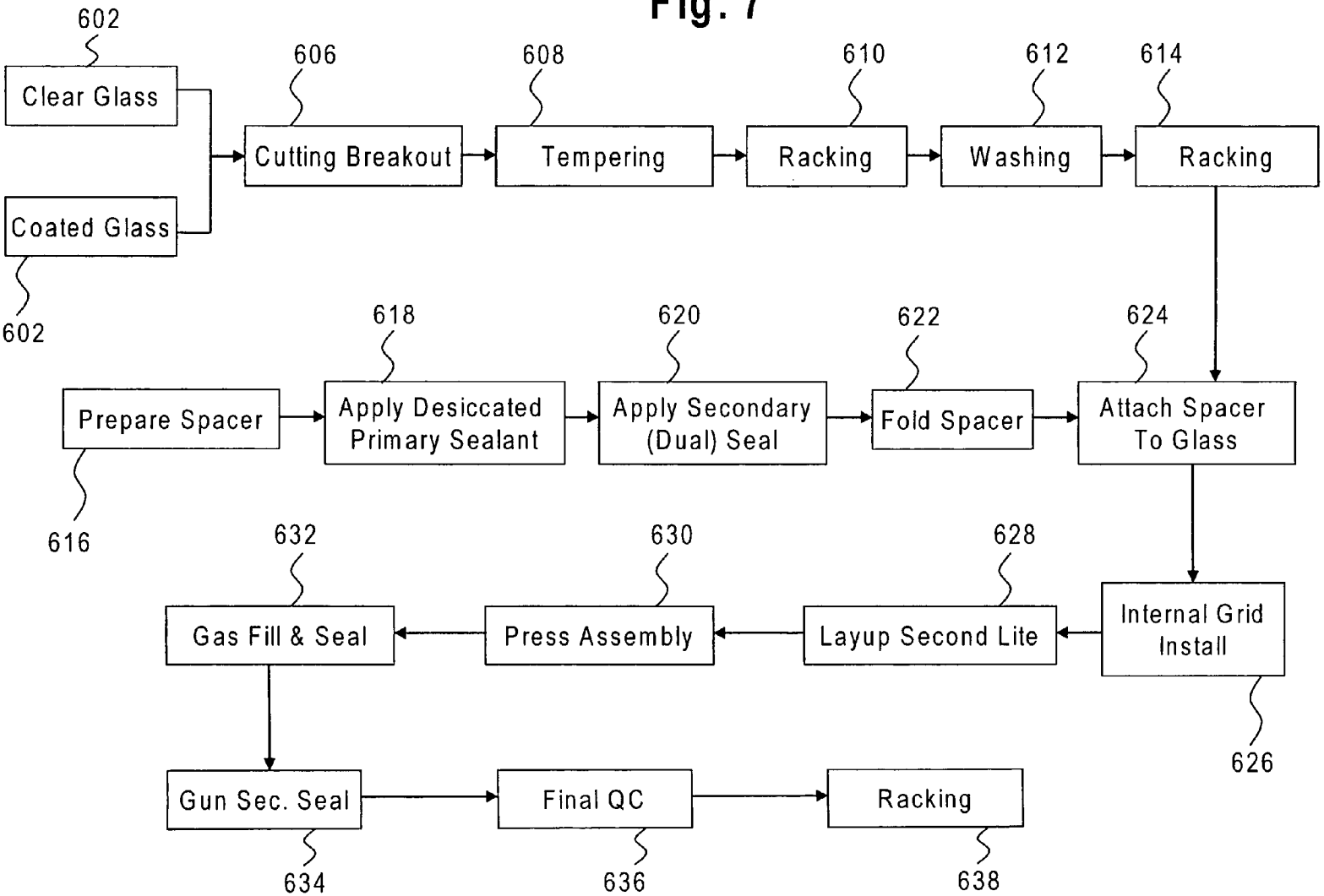
FIG. 7 is a flowchart illustrating a process for making an IG unit with an improved spacer according to certain example embodiments.

FIG. 7 is a flowchart illustrating a process for making an IG unit with an improved spacer according to certain example embodiments. An IG unit that is made out of clear glass and/or coated glass may start with providing the clear or coated glass in step 602. The glass may be cut to a desired size in step 606 and subsequently tempered in step 608. In certain example embodiments, for non-tempered IG units, tempering step 608 may be omitted from the process of making the glass substrates. The tempered glass may be racked (e.g., stored and/or transported) in step 610 and then washed in step 612. Following the washing of the glass substrate in 612, the glass may be racked again. As noted above, the tempering step 608 may be optional depending on the specifications for a given IG unit. Furthermore, some of the steps identified above may be optional depending, in part, on the process employed in creating the glass substrates for the IG unit. For example, the second racking step 614 may be omitted.

As discussed above, certain example embodiments may include spacers of various shapes. Accordingly, spacers used in the making of an IG unit may be prepared in step 616. After preparation a primary sealant with desiccated component may be applied in step 618. As discussed herein, in certain example embodiments, TPS may be used that includes a desiccant component. It will be appreciated that using a primary sealant with a desiccant component may decrease the need to apply a separate and independent desiccant as is normally applied for conventional IG units.

In certain example embodiments, after the application of the primary sealant, a secondary (e.g., dual) seal may be applied in step 620. This may include the application of a structural seal (e.g., 408 in FIG. 4C). The spacer may be folded in step 622.

In step 624, the prepared spacer may be attached to the prepared glass substrates. Next, in step 626, an internal grid may be installed and in step 628 a second lite (e.g., substrate) may be applied to the spacer. The substrates and applied spacer may undergo a press assembly in step 630 that presses the two glass substrates against the spacer. After the press assembly of the substrates and the spacer the gap between the substrates may be filled with a gas and sealed in step 632. The addition of, for example, argon gas between the glass substrates may function to decrease the heat transfer efficiency of the IG unit (e.g., increase the overall R-value of an IG unit). In certain example embodiments, a gun-applied secondary seal may be included in step 634. In certain example embodiments, the applied seal in step 634 may be done in the alternative to the seal applied in step 620. Once the seal is applied in step 634 (or 620) the IG unit may go through a quality control (QC) process to check for a proper seal, cracked glass, etc., in step 636. After this QC process, the finished IG unit may be stored and/or transported (e.g., racked) for future use or shipment in step 638.

As noted above, example IG units may include glass substrates and spacers. The processes for making these components of an IG unit may be separate process. Accordingly, one or more of the steps may comprise separate individual processes. For example, steps 616, 618, 620, and 622 may comprise a separate process for making a spacer that is structured to be disposed between two formed glass substrates. Similarly, the process for constructing a glass substrate used in an IG unit may be performed separately. Indeed, certain example embodiments may include combining the above previously manufactured components to form an IG unit (e.g., from previously constructed spacers and substrates).

Certain steps may be optionally provided depending on design specifications or manufacturing considerations. For example, 608, 614, 620, 626, 632, and 634 may be optionally provided steps according to certain example embodiments.

Certain example embodiments may be solid (e.g., non-perforated), thereby creating a double barrier against moisture transfer into the cavity of an IG unit. Certain example embodiments may include spacers with corrugated faces that may create a structurally stronger element perpendicular to the glass faces.

As alluded to above, one or more of the steps in FIG. 6 may be optional. It also will be appreciated that the various steps may be performed in different orders in different embodiments. Furthermore, the steps may be performed by different parties. For instance, a first party may be responsible for providing a spacer in the desired shape, and a second party may be responsible for assembly the IG unit, in certain example implementations. Still another party may be responsible for making and/or providing the clear and/or coated glass in certain example scenarios.

As used herein, the terms "on," "supported by," and the like should not be interpreted to mean that two elements are directly adjacent to one another unless explicitly stated. In other words, a first layer may be said to be "on" or "supported by" a second layer, even if there are one or more layers there between.

As used herein, the term "substantially transverse" means transverse, plus or minus 10 degrees.

While the invention has been described in connection with what is presently considered to be the most practical and preferred embodiment(s), it is to be understood that the invention is not to be limited to the disclosed embodiment, but on the contrary, is intended to cover various modifications and equivalent arrangements included within the spirit and scope of the claims.

What is claimed is:

1. A method of making a spacer, the method comprising:

providing a base article with first and second shoulder portions;

forming first and second substantially parallel, undulating bands in the base article in a first direction;

pinch rolling portions of the base article to create thinned regions of the base article and define the first and second shoulder portions, the thinned regions being thinner than the first and second shoulder portions;

creating a series of first corrugations in the thinned regions via a first roll-forming operation;

following the first roll-forming operation, creating a series of second corrugations in the thinned regions via a second roll-forming operation, the second corrugations being deeper than the first corrugations;

heating the base article between the first and second roll-forming operations;

shaping the base article in a second direction that is substantially transverse to the first direction to thereby form an enclosed area;

forming the first and second shoulders to be adapted to support first and second substrates of an insulated glass unit, the first and second shoulders being shaped concavely with respect to the first and second substrates such that cavities are formed between the respective shoulders and the first and second substrates, wherein the cavities are adapted to receive a sealing material.

2. The method of claim 1, further comprising laser-welding the shaped base article to form the enclosed area.

3. The method of claim 1, wherein the spacer does not have any breather holes.

4. The method of claim 1, wherein the cavities are generally semi-circular in shape when viewed in cross-section.

5. The method of claim 1, wherein the shoulders are shaped to accommodate the sealing material in order to form a structural seal with the substrates with a strength suitable to obviate the need for primary and/or secondary seals in an insulated glass (IG) unit at least partially defined by the spacer and the first and second substrates.

6. The method of claim 1, wherein the shoulders are shaped to accommodate the sealing material in order to form a structural, desiccant-inclusive seal with the substrates with a strength suitable to obviate the need for primary and/or secondary seals in an insulated glass (IG) unit at least partially defined by the spacer and the first and second substrates.

* * * * *